US010717595B2

(12) United States Patent
Omre et al.

(10) Patent No.: US 10,717,595 B2
(45) Date of Patent: Jul. 21, 2020

(54) CONTAINER CORNER LOCK FOR LOCKING A SHIPPING CONTAINER INTO POSITION

(71) Applicant: LOX CONTAINER TECHNOLOGY AB, Stockholm (SE)

(72) Inventors: Kent Omre, Stockholm (SE); Christoffer Lönn, Sundbyberg (SE); Gunnar Schlyter, Sollebrunn (SE)

(73) Assignee: LOX CONTAINER TECHNOLOGY AB, Stockholm (SE)

( * ) Notice: Subject to any disclaimer, the term of this patent is extended or adjusted under 35 U.S.C. 154(b) by 0 days.

(21) Appl. No.: 16/340,400

(22) PCT Filed: Sep. 28, 2017

(86) PCT No.: PCT/EP2017/074691
§ 371 (c)(1),
(2) Date: Apr. 9, 2019

(87) PCT Pub. No.: WO2018/077568
PCT Pub. Date: May 3, 2018

(65) Prior Publication Data

US 2019/0241358 A1 Aug. 8, 2019

(30) Foreign Application Priority Data

Oct. 27, 2016 (SE) ..... 1651403

(51) Int. Cl.
*B65D 90/00* (2006.01)
*G07C 9/00* (2020.01)

(52) U.S. Cl.
CPC ..... *B65D 90/0013* (2013.01); *G07C 9/00309* (2013.01); *B65D 2590/0033* (2013.01);
(Continued)

(58) Field of Classification Search
CPC ..... Y10T 24/28; B65D 2590/033; B65D 90/0013
See application file for complete search history.

(56) References Cited

U.S. PATENT DOCUMENTS 5,454,673 A * 10/1995 DiMartino ..... B65D 90/0006 24/287
7,942,282 B2 * 5/2011 Hung ..... B65D 90/0013 206/503
(Continued)

FOREIGN PATENT DOCUMENTS

DE 297 23 812 9/1997
DE 200 59 260 11/2000
(Continued)

OTHER PUBLICATIONS

International Search Report issued in international application No. PCT/EP2017/074691, dated Dec. 12, 2017, pp. 1-3.
(Continued)

*Primary Examiner* — Robert Sandy
(74) *Attorney, Agent, or Firm* — Jeffrey S. Melcher; Melcher Patent Law PLLC

(57) ABSTRACT

A lock for securing upper and lower superimposed shipping containers in place, said lock comprising:—a housing (1) having a top portion (13) and a bottom portion (14), fitting in an opening (21) in a corner casting (2, 2') of the upper and lower container (3, 3'), respectively; —said housing (1) comprising a first (11) and a second (12) housing part; and—said first housing part (11) having a side opening (111) at a lower end of the bottom portion (14);—a pivotal first hook (31) in the housing (1) having a hook end (311) movable out and back through the side opening (111) to couple the lock to and uncouple the lock from the corner casting (2');—a shaft (41) having a fixed locking bar (42) to either lock the hook (31) in the moved-out position of said
(Continued)

hook end (311) or permit the hook (31) to move between the moved-out position and the moved-back position of said hook end (311); and—said top portion (13) having a head (132), a neck (131), and around the neck a retaining flange (133) for providing a retaining function when the top portion (13) is fitted in the corner casting opening (21) of the upper container (3).

23 Claims, 12 Drawing Sheets

(52) U.S. Cl.
CPC ..... *B65D 2590/0083* (2013.01); *G07C 2009/00642* (2013.01)

(56) References Cited

U.S. PATENT DOCUMENTS

| | | | |
|---|---|---|---|
| 2010/0089914 | A1 | 4/2010 | Hung |
| 2016/0107804 | A1 | 4/2016 | Lanigan |

FOREIGN PATENT DOCUMENTS

| | | |
|---|---|---|
| EP | 1 937 511 | 7/2008 |
| JP | 61-178392 | 11/1986 |
| KR | 10-1642759 | 7/2016 |
| WO | 2007/142531 | 6/2007 |
| WO | 2007/142531 | 12/2007 |
| WO | 2009/023236 | 2/2009 |
| WO | 2011/110743 | 9/2011 |
| WO | 2016/060961 | 4/2016 |

OTHER PUBLICATIONS

International Preliminary Report on Patentability issued in international application No. PCT/EP2017/074691, dated Dec. 11, 2018, pp. 1-17.

International Preliminary Report on Patentability issued in international application No. PCT/EP2017/074691, dated Dec. 12, 2017, pp. 1-12.

* cited by examiner

CONTAINER CORNER LOCK FOR LOCKING A SHIPPING CONTAINER INTO POSITION

TECHNICAL FIELD

The present invention relates to a lock for locking a shipping container in place when superimposed onto a lower container.

BACKGROUND ART

A twistlock and corner casting together form a standardized rotary connector for securing and locking shipping containers onto one another when stacked e.g. on a container ship, semi-trailer truck or railway container train. The corner casting constitutes a female part of the connector and is fitted to the container itself, one in each of the eight corners. It has no moving parts, only oval holes in its side-, top- and bottom surfaces respectively. The male component is a twistlock, which is arranged to engage the corner casting and comprises a rotary top portion and a rotary bottom portion, and is inserted through the hole. Then, the top portion or the bottom portion is rotated 90° to lock the twistlock to the corner casting. Referring to FIG. 1, according to established methods, the twistlocks are manually introduced into the four lowermost corner castings of a container on the quay and subsequently locked into place. In this position, the twistlock has one portion being locked inside the corner casting, and one portion protruding in a downward direction out of said corner casting. The container is then moved to the ship, normally by means of an STS crane (ship to shore crane) with a spreader, and is to be superimposed onto an already loaded container on the ship. The protruding portions of each of the four twistlocks of the container to be loaded are then inserted into the uppermost corner castings of the container already positioned on the ship, thereby securing the two containers onto each other and preventing them from e.g. shifting away from each other or slipping into the sea.

Since the 1950's, the male locking device of the rotary connector is further developed to avoid having to rotate the bottom portion manually when attaching the lock to a corner casting. The dimensions of the corner castings are standardized in ISO 1161:1984.

Document DE10 2009 019 955 A1 discloses a locking device having a housing and a vertical locking member rotary mounted in the housing. By rotating the locking member, the locking device can engage the corner casting or be disengaged there from. A stop member, which can be brought into engagement with the locking member, is movable by means of a guide member, so that the stop member at one position prevents the locking member from rotating and at another position permits the rotation.

Document EP 2 910 421 A2 discloses a locking device comprising a housing and a locking mechanism, which by means of a manually operated control lever can be shifted between a locking position, where the locking mechanism locks the locking device to a corner casting, and an open position, where the locking mechanism and the corner casting are free from each other. The locking mechanism includes at least one pivotal arm with a hook end. When two arms are used, they are swung in opposed directions. The locking device is suitable for mounting on a vehicle or similar fastening location for a shipping container that is lowered down on it. However, there is no disclosure as to how the locking device is secured to the vehicle or similar fastening location.

Document EP 2 143 665 A1 discloses a locking device for securing together upper and lower shipping containers to prevent a stack of shipping containers from shifting away from one another or slipping into the sea from a container ship. The locking device includes interconnected upper and lower retaining members, each adapted to be inserted into a hole in a corner piece of a respective one of the upper and lower shipping containers, and at least one swing member disposed inside the lower retaining member. The upper retaining member has a top end aligned with a bottom end of the lower retaining member along an axial line of the locking device. The swing member includes a lower pivot portion connected pivotally to the lower retaining member, and an upper engaging portion which is proximate to the axial line in a non-engaging position and when the axial line of the locking device is substantially vertical, and which moves away from the axial line in an engaging position when the axial line of the locking device is inclined and non-vertical.

Document WO 2005/054086 A1 discloses a method for the automatic locking and unlocking of coupling pieces, whereby an at least partial locking of the coupling pieces occurs on a displacement of the shipping container in the plane of the deck, which can be reversed by an opposing displacement of the container. A fully-automatic coupling piece comprises a coupling projection, for vertical connection of the container, with anchoring lugs, running in the transverse direction of the container of which at least one anchoring lug may be displaced. The aim is to use a relative displacement of the container, in the direction of the deck, for carrying out an automatic locking of the container. On reversal of said displacement, an equally automatic unlocking of the container is possible.

Document WO 2011 110743 A1 discloses a coupling device for coupling shipping containers, particularly for coupling containers used in container ships and land transport. The coupling device includes a fastening piece formed in the upper part of its body part, by which the body part can be fastened in a corner casting in a corner of the container by rotating the body part around its vertical axis, whereby the fastening piece is locked in the corner piece of the container. The body part includes a planar coupling plate formed between its upper part and lower part, and the body part further includes a cam part below the coupling plate. In addition, body part is fitted with a first rotatable lever-like locking part for preventing and/or releasing the motion of the body part, and the body part includes a second rotatable lever-like locking part for enabling and/or preventing the motion of the body part. The second lever-like locking part is either directly or indirectly in contact with the first lever-like locking part so that, as the first lever-like rotates, the second lever-like locking part is also able to rotate for enabling the locking mode and the unlocking mode. In the second lever-like locking part, there is formed a protrusion for receiving vertical forces between the containers.

U.S. Pat. No. 8,228,185 B2 and U.S. Pat. No. 8,228,186 B2 disclose systems for remote control of the locking and unlocking of a lock for a shipping container.

SUMMARY OF THE INVENTION

It is an object of the present invention to provide a lock for locking a shipping container in place when superimposed on another container e.g. on a container ship, which prevents unintentional release of two superimposed, loaded containers e.g. by sudden, vertical and horizontal movements which may occur on a cargo ship in case of rough seas.

This object is achieved by means of a lock according to claim 1.

Thanks to this solution, once being in a locked configuration where the bottom portion is introduced into a corner casting of a lower container and the hook member is locked into a moved-out position, the lock according to claim 1 will retain the upper and lower containers together regardless of direction of movement of said containers. For instance, when loaded onto a cargo ship, the loaded containers may be subjected to strong and unpredictable forces when large waves causes the vessel to e.g. heave, roll and yaw. A lock according to claim 1 will keep two containers steadily linked to one another even in case of sudden vertical and horizontal movements.

Other objects of the invention is to provide a lock which may be locked as well as unlocked automatically on the ship (i.e. no manual handling required on board) and which enables for automatic, remote validation as to whether the lock is actually in a locked configuration or not once the container is loaded.

Another object is to provide said lock with components enabling remote control of the locking and unlocking function of the lock. Thereby, an external control unit, which may be handheld or mounted accessible for the operator in the container crane, can be used to control the locking/unlocking of the lock. Thus, thanks to the invention the lock may be automatically maneuvered (locked/unlocked) and no manual handling is required on board. This is a great advantage since such automatization provides for drastically improved security level for personnel: every year a number of persons are involved in accidents associated with handing/locking of container locks on container ships due to heavy weather (rain, wind etc), sometimes in combination with bad sight.

A remote control of locking also enables for a convenient way of validate whether the lock is actually in a locked configuration or not once the container is loaded.

According to one aspect of the invention, the lock fills out the opening of the corner casting so that the container is prevented from sliding sideways which leads to a robust and reliable connection of the lock into the corner casting.

This and other objectives, advantages and aspects of the invention can be achieved in that the lock comprises the features claimed in claim 1. Other features and aspects of the invention are defined by the independent claims or are evident from the description of a preferred embodiment.

BRIEF DESCRIPTION OF THE DRAWINGS

In the following, the invention will be described in more detail with reference to a preferred embodiment and the appended drawings.

MODE(S) FOR CARRYING OUT THE INVENTION

Figure 1D:
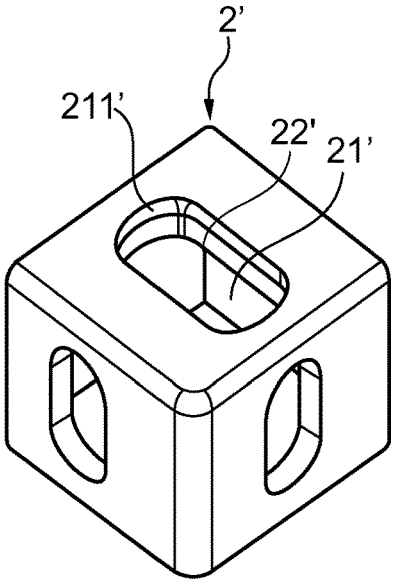
FIG. 1*d* is an isometric view of an uppermost corner casting of a container, viewed at an angle from above.
Figure 2A:
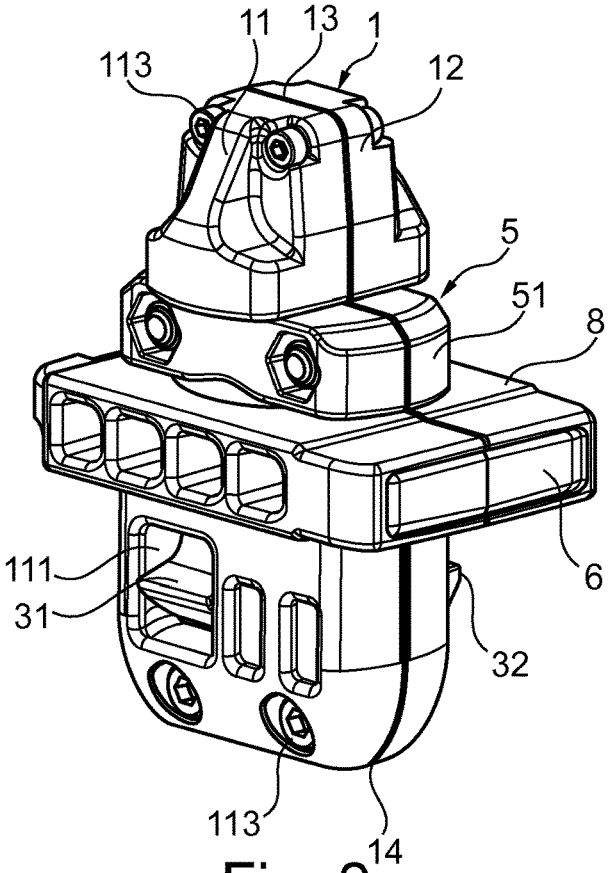
FIG. 2*a* is an isometric view of a lock according to a preferred embodiment of the present invention showing a first hook member retracted into a housing.
Figure 2B:
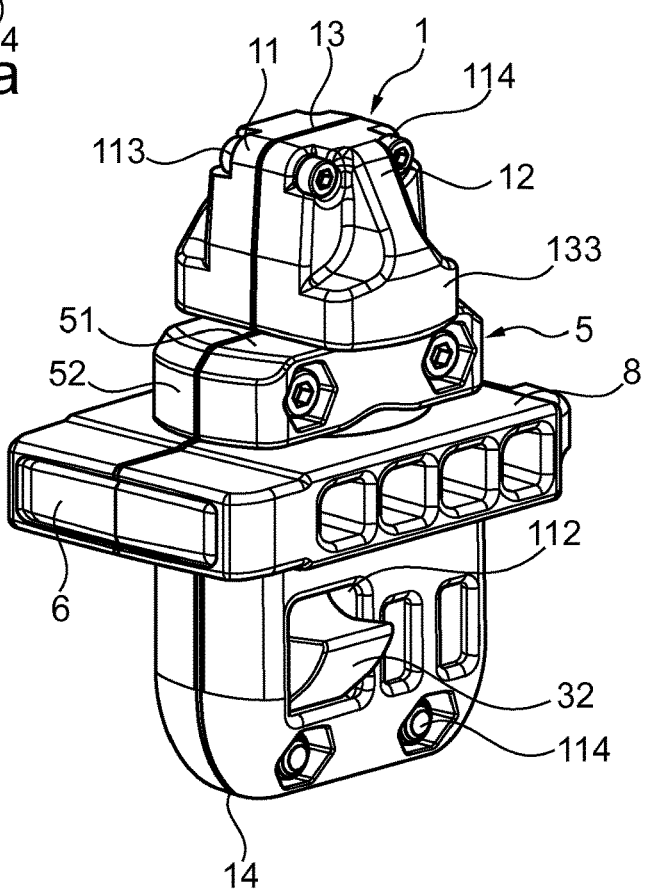
FIG. 2*b* is an isometric view of the lock of FIG. 2*a* rotated 90° around a vertical axis showing a second hook member pushed out through an opening in the casing.
Figure 2C:
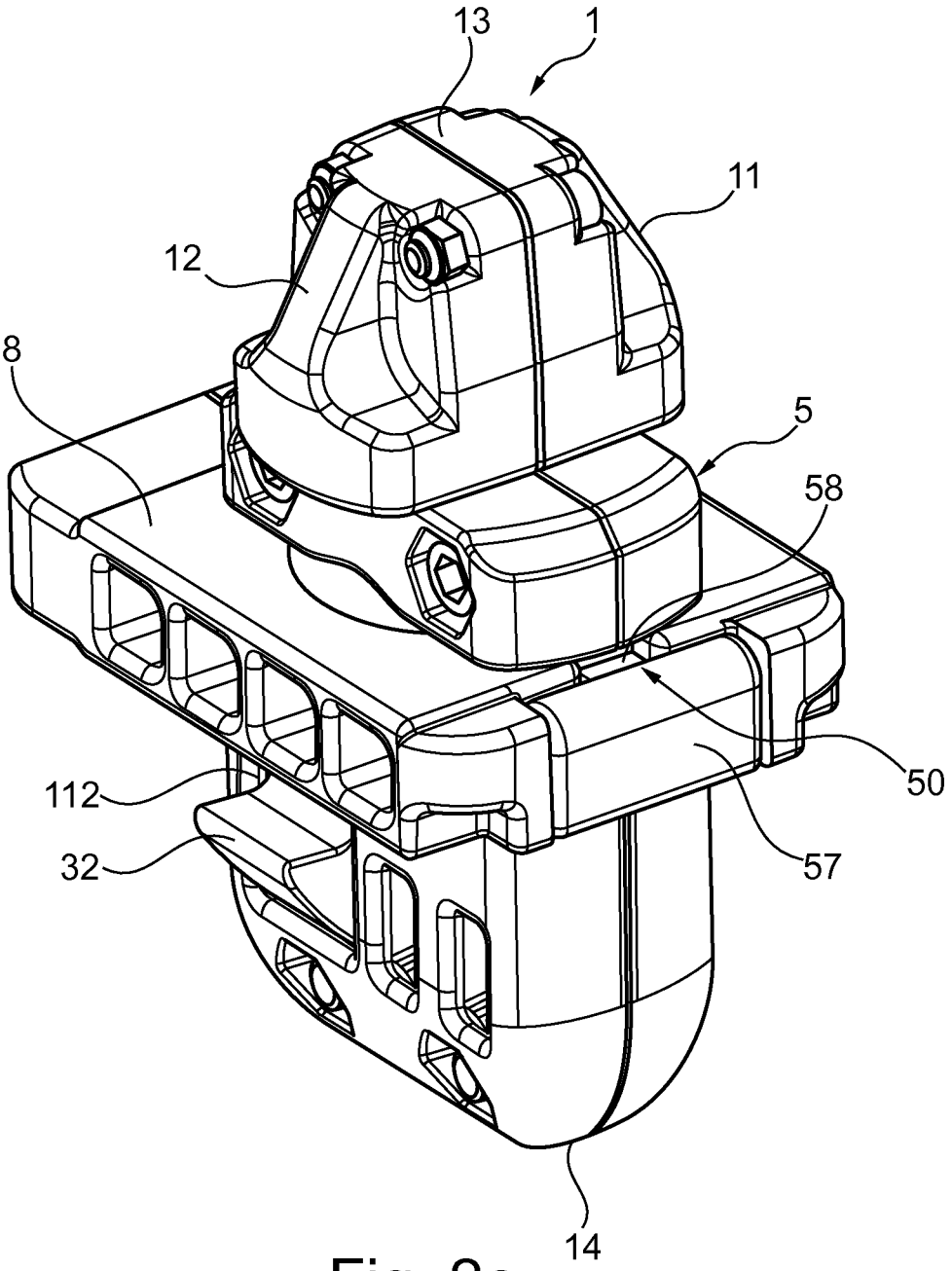
FIG. 2*c* is an isometric view of the lock of FIG. 2*a*, rotated 180° around a vertical axis.

FIGS. 2*a-c* show a preferred embodiment of a lock for locking a shipping container 3 in place when superimposed on another, lower container 3' e.g. on a container ship. The lock comprises a vertical housing 1 having a top portion 13 and a bottom portion 14, where the bottom portion 14 has a shape fitting in a dedicated opening 21' in a corner casting 2' (shown in FIG. 1*d*) of a container 3'. The corner casting opening 21' is generally oval, but its two long sides are parallel to each other. The housing 1 is divided vertically into a first housing part 11 and a second housing part 12, and at least the first housing part 11 has a side opening 111 at a lower end of the bottom portion 14. The two housing parts 11 and 12 are attached to each other by screws 113 and nuts 114 to form the housing 1.

Figure 1A:
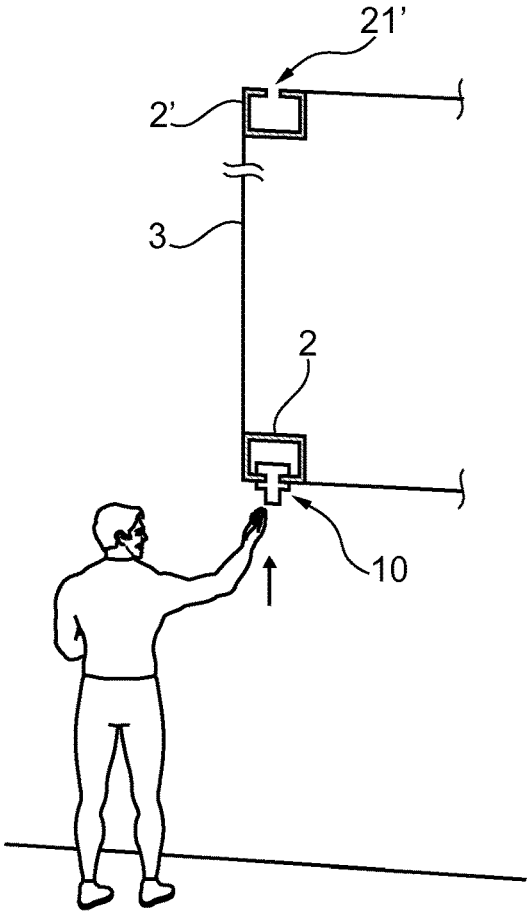
FIG. 1*a* illustrates how a conventional lock according to prior art is secured into the corner casting of a container.
Figure 1B:
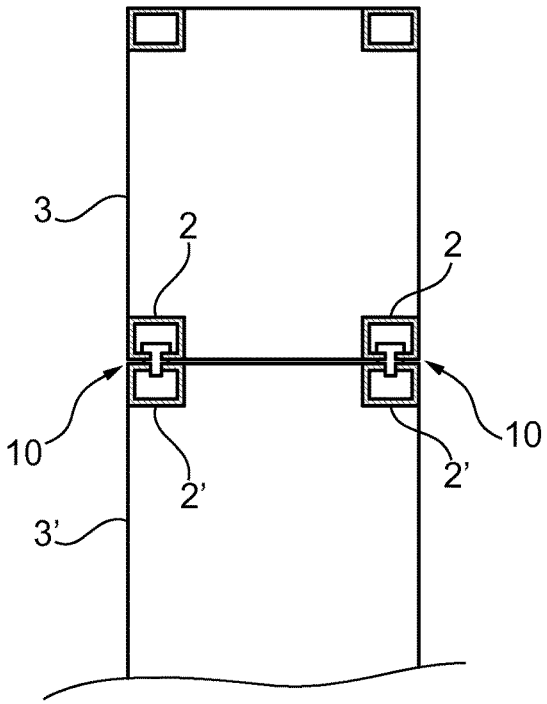
FIG. 1*b* is a schematic view showing a cross section of two superimposed containers.
Figure 1C:
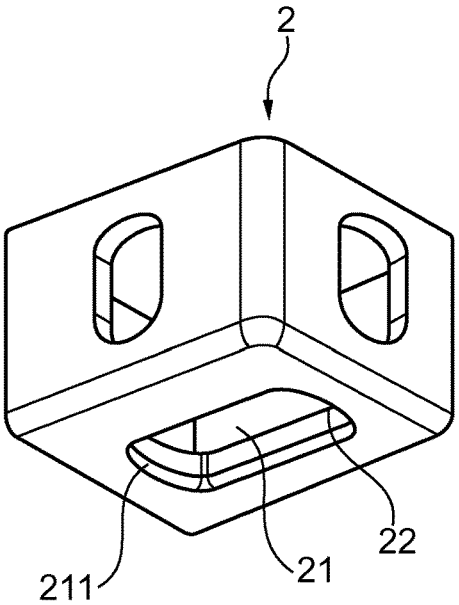
FIG. 1*c* is an isometric view of a lowermost corner casting of a container, viewed at an angle from below.

FIGS. 1*a-b* illustrates the established principle of manually attaching a lock 10 into a corner casting 2 of a container 3 on the quayside. In a corresponding manner to shown in FIG. 1*a*, the lock according to the invention is also arranged to be manually positioned into the lowermost corner castings 2 of a container 3, one in each of the four corners. When such positioning of the locks is completed, a container crane transports the shipping container 3 by lifting from the quay onto the container ship whereat said container 3 is to be superimposed onto an already loaded container 3', as schematically illustrated in FIG. 1*b*. At this point, the bottom portions 14 of the respective locks that are protruding from the corner castings 2 are arranged to be introduced and fitted into the upper corner castings 2' of the lower, already loaded container 3'. Upon being rightfully positioned, the locks 10 at each corner is actuated into a locked configuration, according to the invention preferably by remote control of the lock which eliminates the need for manual locking on board. Once in position on a ship, each of the four locks connects and retains an upper 3 and a lower 3' container via their lowermost 2 and uppermost 2' corner castings respectively.

Referring again mainly to FIGS. 2*a-c*, the lock further comprises a first hook member 31, which is pivotally mounted within the housing 1 and has a hook end 311 that can be moved out and moved back through the side opening 111 to couple the lock to and uncouple the lock from the corner casting 2', and a shaft 41 (see e.g. FIG. 6), which is mounted in the housing 1 and operatively connected to said at least one hook member 31 to either lock the hook member 31 in the moved-out position of said hook end or permit the hook member to move between the moved-out position and the moved back position of said hook end 311. Further, the top portion 13 of the housing 1 has a neck 131 and there above a head 132 comprising a retaining flange 133 arranged to provide a retaining function when the top portion 13 is fitted into said dedicated opening 21 in the corner casting 2 of the upper container 3.

Figure 9A:
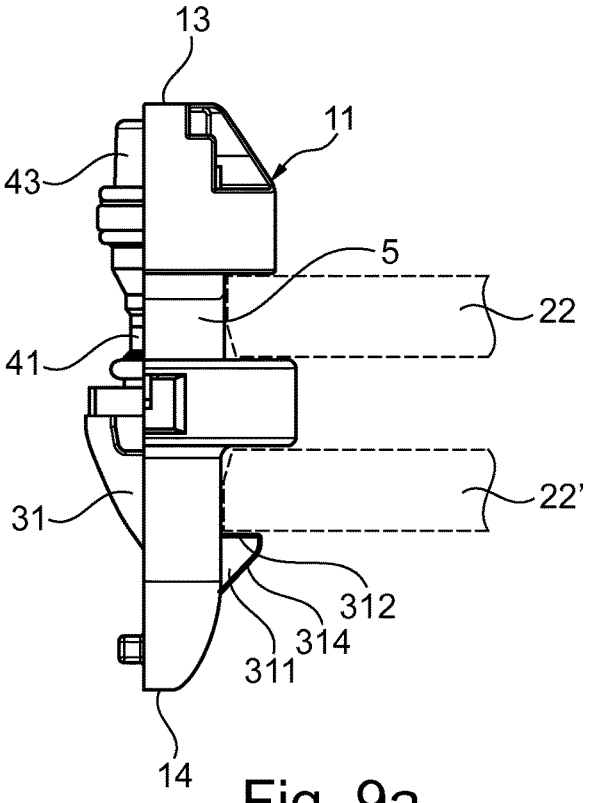
FIG. 9*a* is a side view of the lock of FIG. 1 with some parts removed and one hook member in a pushed out to a position where it has a generally horizontal abutment surface abutting on the inner top side of a corner casting.
Figure 9B:
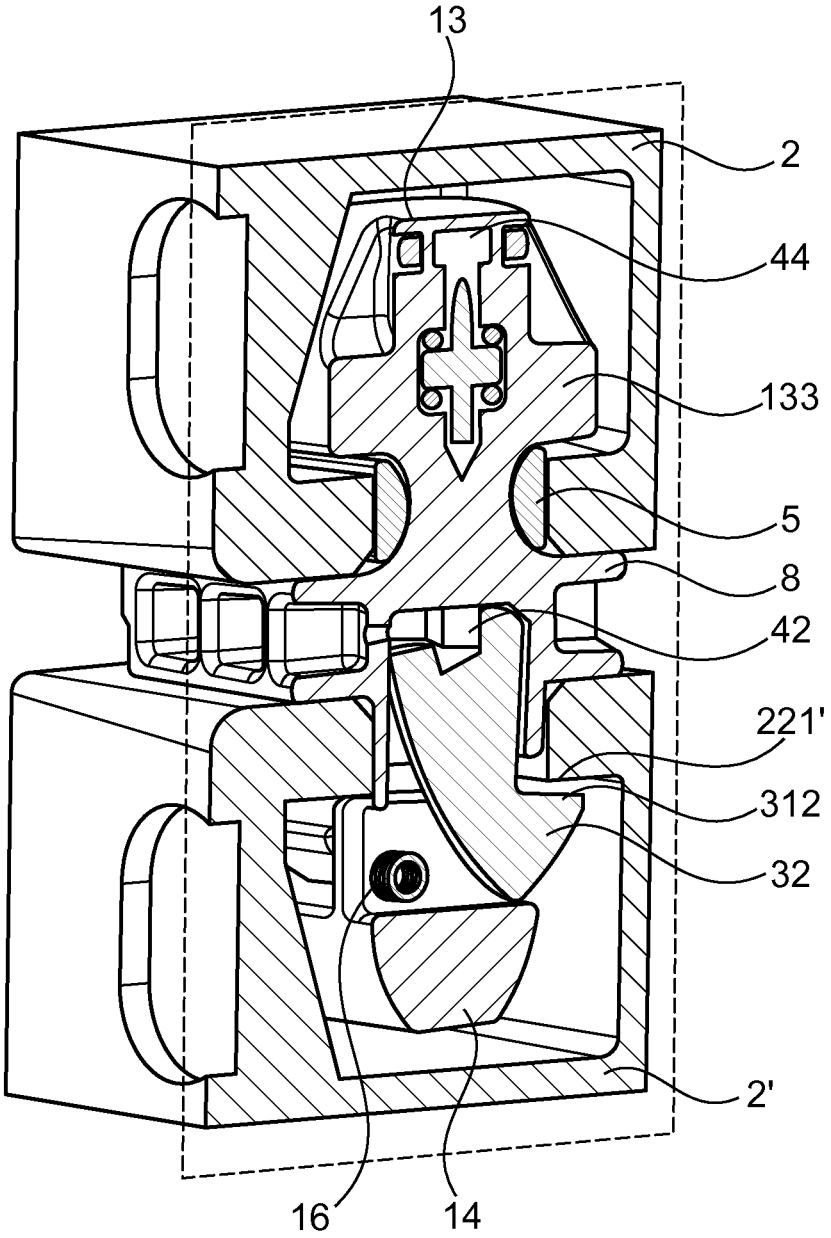
FIG. 9*b* is a cross sectional side view showing a lock according to a preferred embodiment when positioned and secured into an upper and a lower corner casting respectively.

In a preferred embodiment, the lock also comprises a guide neck 5 (also here referred to as "rotary ring member") that is mounted around the neck 131, which guide neck 5 has a peripheral shape made to fit in a dedicated opening 21 in a lowermost corner casting 2 of a shipping container 3 (see FIGS. 1*a* and 9*b* respectively). To permit the mounting of the guide neck 5 around the neck 131, the guide neck 5 is divided into two identical halves 51 and 52 that are fixed to each other by screws 53 and nuts 54.

Figure 3:
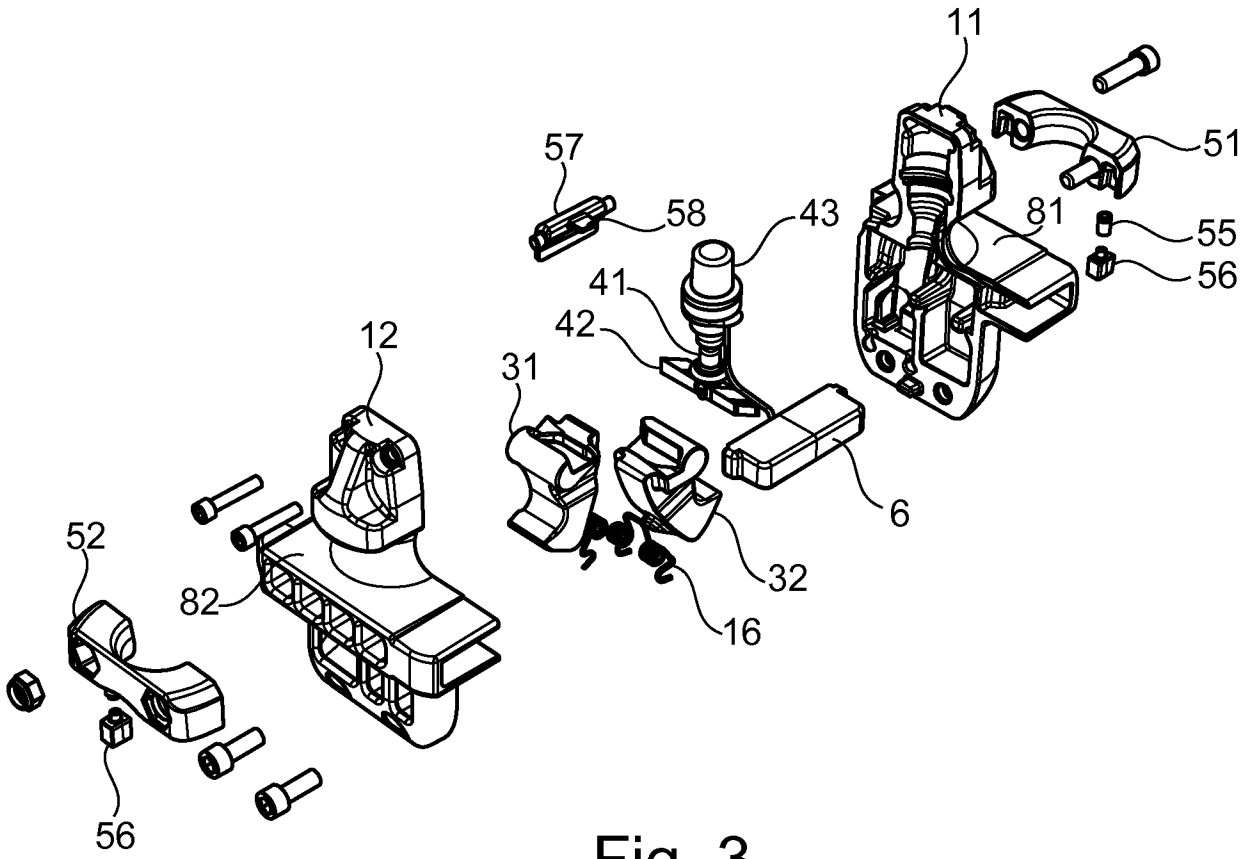
FIG. 3 is an exploded view of the lock of FIGS. 2*a-c*.

The isometric view of FIG. 2*c* shows the guide neck 5 positioned around the neck 131 where the housing 1 and the retaining flange 133 is twisted a quarter of a turn in relation to the guide neck. Herein is also seen that both the head 132 and the guide neck 5 are designed to fit in a dedicated opening 21 of a corner casting 2. The guide neck is also arranged to be rotatable around the neck of the housing. The housing 1 and guide neck 5 also comprises a guide ring lock 50 positioned at one side of the intermediate part 8. The components of the lock are seen also in the exploded view of FIG. 3. Said lock 50 comprises a spring member 55 positioned in a recess inside the guide neck, a locking unit 56 abutting the spring and urged by the spring to protrude out of the recess, a lever 57 pivotally mounted at the intermediate part of the housing, and a locking support 58 presenting a cavity in the intermediate part. When in a locked position, the locking unit 56 is arranged to rest on the locking support 58 which, in its turn, is part of the lever 57.

When introducing the top portion 13 into a dedicated opening 21 of a corner casting 2, the head 132 of the housing 1 and the guide neck are aligned so that they both can be fitted into said opening 21. The guide neck 5 now fills essentially the entire opening with its body. Next, the housing 1 is turned in relation to the guide neck 5 (which is fixated by being form fitted in the opening 21) until the locking unit 56 reaches the locking support 58. The locking unit 56 is then urged by the spring 55 to enter the cavity at the locking support to prevent further rotation of the guide neck 5 and lock it in the corresponding position. In this configuration, the retaining flange 133 has been twisted a quarter of a turn inside the corner casting so that the head 132 is prevented from exiting the dedicated opening unless said guide neck lock 50 is opened by means of activating the lever 57.

Figure 5A:
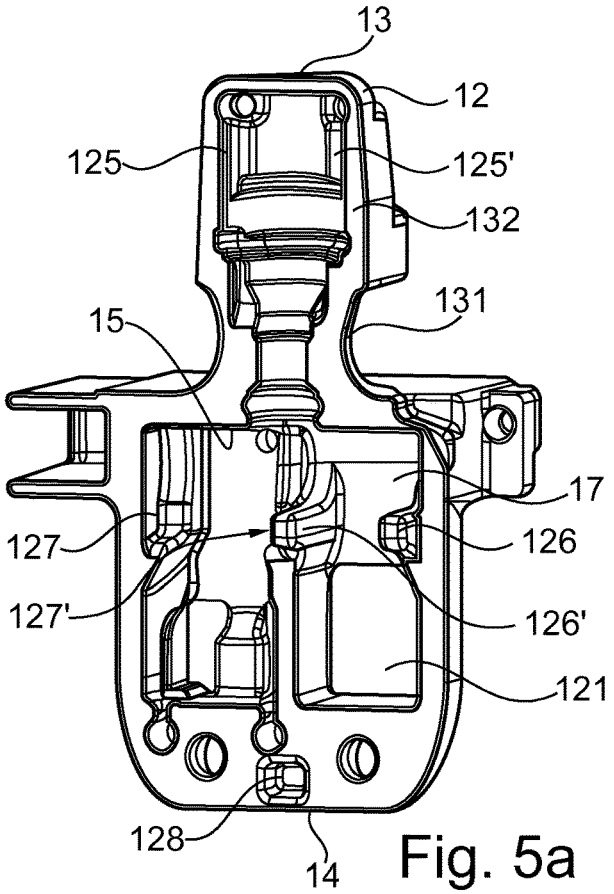
FIGS. 5*a-b* are side views of showing the interior of the two housing parts respectively.
Figure 5B:
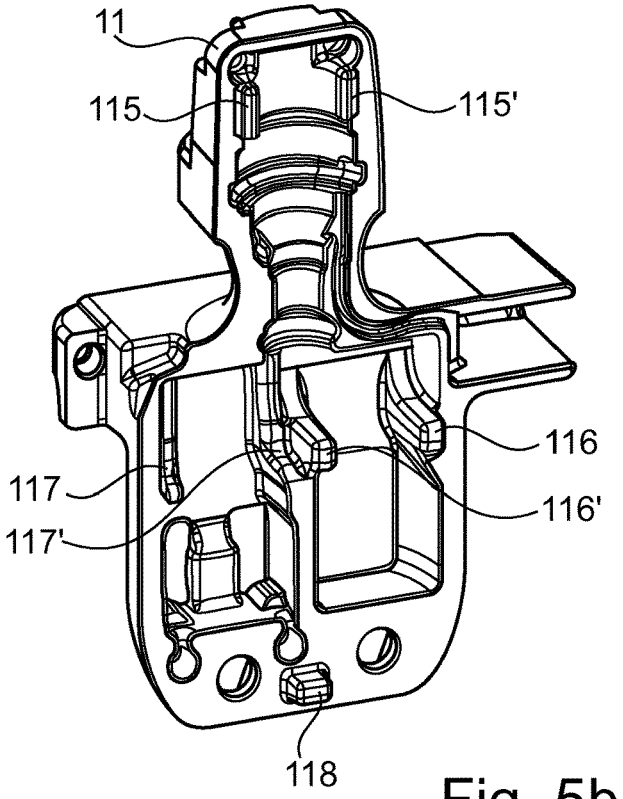

FIGS. 5*a-b* show isometric views of the two housing parts (FIG. 5*a* showing the second housing part 12 and FIG. 5*b* showing the first housing part 11). The two halves are arranged to be attached together by screws 113 and nuts 114, and are also arranged to be stabilized onto each other, once begin screwed together, by means of supporting and stabilizing protrusions and meeting corresponding recesses. It is e.g. seen in FIG. 5*a* that the second housing part is exposing a pair of upper recesses 125, 125', a pair of central/middle protrusions 126, 126' as well as a pair of central/middle recesses 127, 127' and also a lower recess 128. These parts are compatible with protrusions and recesses of the meeting, first housing part 11 in FIG. 5*b*, which in a corresponding manner comprises upper protrusions 115, 115', central/middle recesses 117, 117' and central/middle protrusions 116, 116' and a lower protrusion 118. Once attached to one another to form a housing 1 the protrusions and recesses contribute to increased strength of the lock, which upon use on a container ship will have to endure and hold for large forces and impacts. The skilled person understands that the protrusions and recesses may be designed in other ways than in the herein shown example in FIGS. 5*a-b*.

Figure 10:
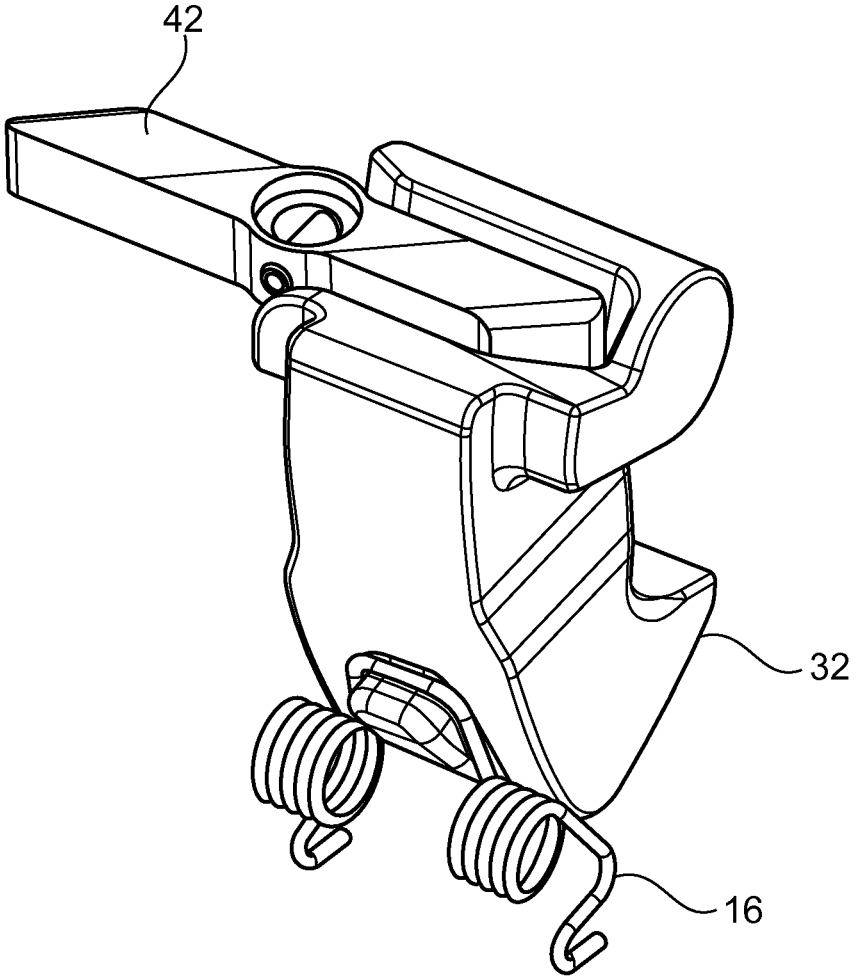
FIG. 10 is a detailed view, showing a spring member associated with one of the hook members.

As is best shown in FIGS. 9*a*-9*b*, the hook end 311 of the hook member 31 in the moved-out position has a generally horizontal first abutment surface 312 adapted to abut on an inner side 221' of a generally horizontal wall 22' of the corner casting 2'. As further shown in FIG. 10, a spring 16 is arranged to press the hook member 31 toward the moved-out position of the hook end 311. Then, the hook end 311 has a bottom portion 313 with a guide surface 314 that faces outward from the housing 1. On insertion of the lock in the corner casting 2', this guide surface 314 will abut on a rim 211' of said opening 21' in the corner casting 2' to resiliently guide the lock to a predetermined position. (In this context, a prim sign (') is used to designate association of a reference sign with upper corner casting 2' of a container.) Suitably, to facilitate the entering of the bottom portion 14 into the hole 21' in the corner casting 2', the hole 21' has a conical or funnel-like cross-sectional shape, and the bottom portion 14 of the housing 1 is rounded but truncated. Thereby, a container 3 provided with the locks of the present invention does not have to be positioned exactly right above a container it shall be attached to. Minor sideways corrections will be carried out automatically, and on insertion of the lock into the corner casting 2', the spring loaded hook members 31 while passing through the holes 21' will first be pressed back to their moved-back position in the housing 1 to permit the lock to enter the corner casting 2' but return to their moved-out position and secure the container 3 as soon as they have passed through the holes 21'.

Figure 6:
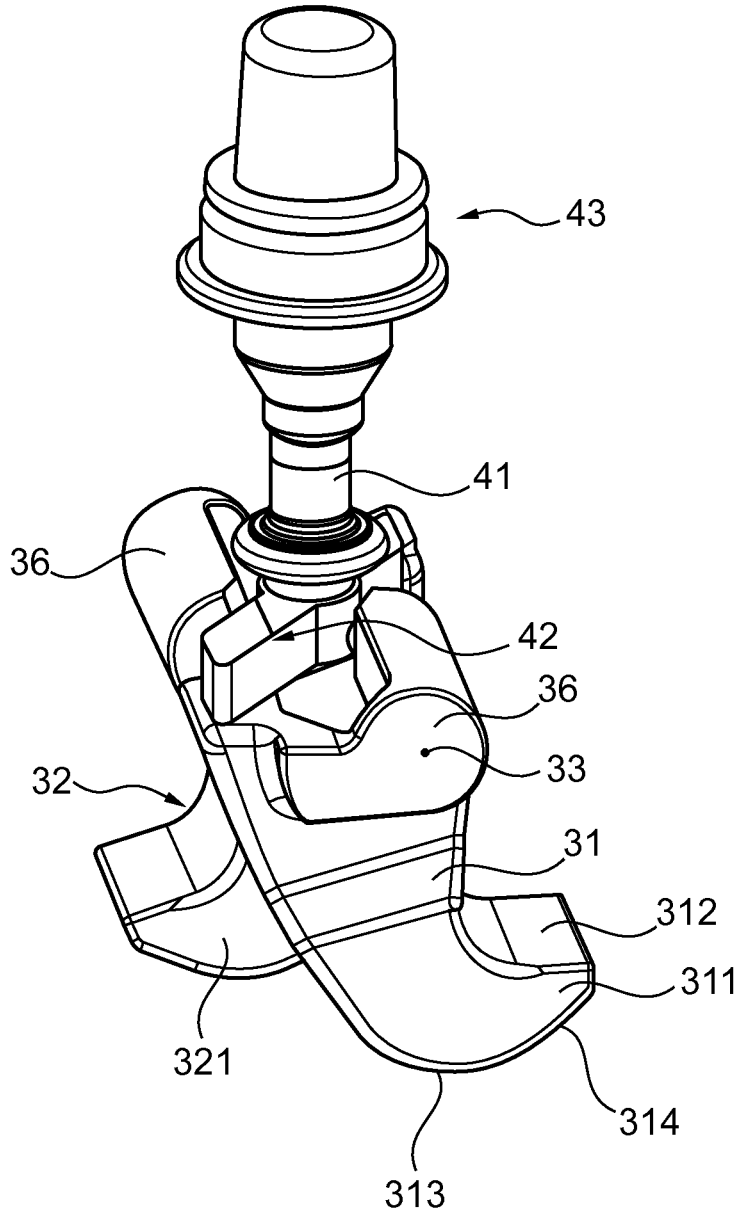
FIG. 6 is an isometric view of the motor, a transversal locking bar, and the two pivotal locking members.
Figure 7:
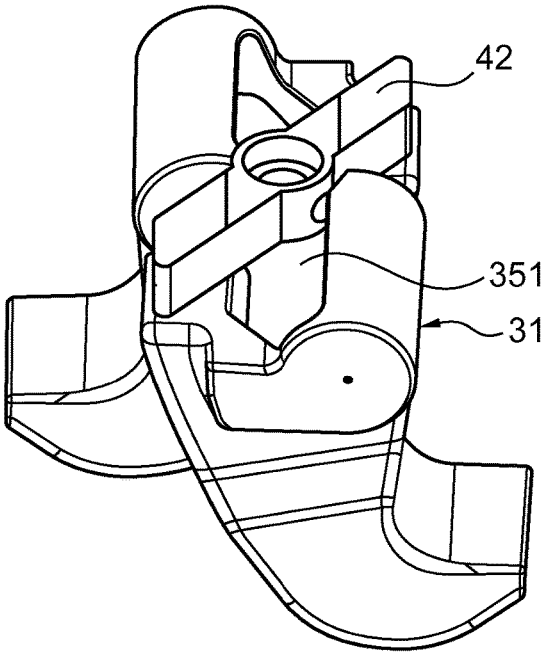
FIG. 7 is an isometric view showing the position of the transverse locking bar when the hook members are in a pushed out position, thus blocking the pivotal movement of the hook members.
Figure 8:
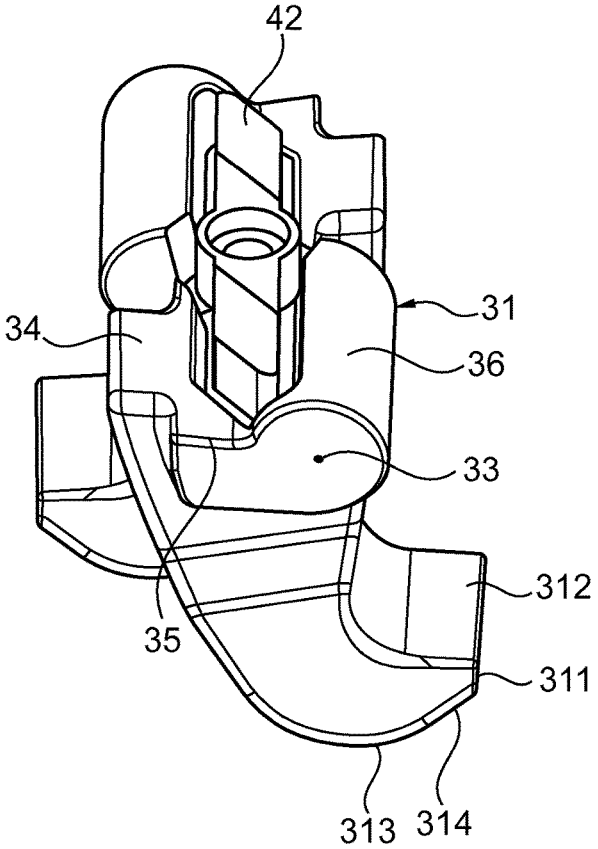
FIG. 8 is an isometric view similar to FIG. 7 but showing the position of the transverse locking bar in a mode that enables the hook members to move from extended to retracted position.

As is best shown in FIGS. 6, 7 and 8, the hook member 31 has a pivot axis 33 and a locking surface 34 adjacent the pivot axis 33. The hook member 31 has a shoulder 35 that projects generally horizontally from the pivot axis 33 and, with reference to an intermediary vertical plane, in a direction opposed to that of the hook end 311, and the locking surface 34 is located on said shoulder 35. A locking bar 42 is fixed to the shaft 41 which upon movement of the shaft 41 is movable between a locking position shown in FIGS. 6 and 7, where the locking bar 42 engages said locking surface 34 of the hook member 31, and a free position shown in FIG. 8, where the locking bar 42 is out of engagement with the hook member 31.

The opposite end of the hook member 31 in relation to the hook end 311 has the shape of a transversal sturdy rod 36 of circular cross-section, and the rod has a longitudinal axis that coincides with the pivot axis 33. The two halves 11, 12 of the housing 1 together form a seat 17 for the rod 36 to permit the pivoting movement of the hook member 31 between the moved-out position and the moved-back position.

The shoulder 35 has a recess 351 that is best shown in FIG. 7 and located at the side of the locking surface 34 and also extending into a portion of the rod 36. The recess 351 is shaped to receive a portion of the locking bar 42 in the free position to permit the hook member 31 to move back into the housing 1. When the locking bar 42 is in the free position, the spring loaded hook member 31 can be pressed back from its moved-out position to its moved-back position against the force of the spring 16. The housing 1 has an internal abutment 15 shown in FIG. 5*a* that stops any vertical upward movement of the hook member shoulder 35 and the locking bar 42, when the locking bar 42 locks the hook member 31 in moved-out position and the hook member 31 is exposed to a pivotal force.

The head 132 of the housing top portion 13 has a peripheral shape made to fit in a dedicated opening 21 in corner casting 2 of the container, and the head 132 is oriented perpendicularly to an orientation, i.e. main horizontal extension, of the housing bottom portion 14. After insertion of the lock from below into an opening 21 in the corner casting 2, so that the head 132 has passed upward through the opening and the ring 5 is fitted in the opening 21, the lock is rotated a quarter of a turn around a vertical axis to fix the lock to the corner casting 2. The bottom portion 14 of the housing 1 now has the required orientation to fit in the hole 21' of the upper corner casting 2' of an already loaded container 3'.

In the preferred embodiment shown in the drawings, also the second housing part 12 has a side opening 112 at a lower end of the bottom portion 14, an additional hook member 32 is pivotally mounted within the housing 1 and has a hook end 321 that can be pushed out and retracted through the side opening 112 of the second housing part 12. The hook members 31 and 32 are mounted to move in opposite directions relative each other, so that they in their moved-out position project outwards from their respective housing part 11 and 12, respectively. All description above relating to the first hook member 31 is applicable also to the second hook member 32. The shaft 41 is operatively connected to both of the hook members 31 and 32 thus being able to switch between a locked and an unlocked configuration respectively. In said locked configuration (see FIG. 7), said locking bar 42 is arranged to engage said locking surface 34 of the respective hook members 31, 32 thus keeping them in a pushed out position (preventing retraction), and correspondingly, in said unlocked (free) position (see FIG. 8) the bar 42 is moved to be located adjacent to, and above said recess 351 whereby said hook members 31, 32 are permitted to retract and move back into the housing 1 against the force of the spring 16.

Figure 11A:
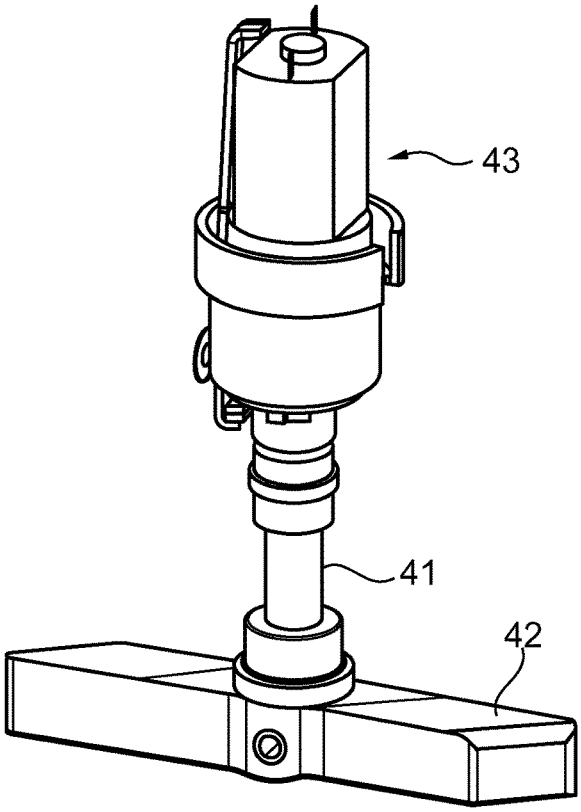
FIG. 11*a* is an isometric view showing the shaft and motor connected to a locking bar.
Figure 11B:
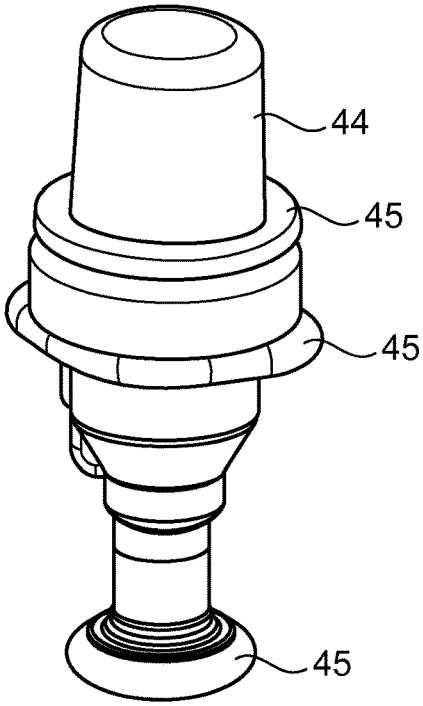
FIG. 11*b* is an isometric view showing a cover to a motor as shown in FIG. 11*a*.

The motor 43, the thereto connected shaft 41 and the locking bar 42 are shown in FIG. 11*a*. FIG. 11*b* shows a cover for said motor and shaft respectively. Preferably, the motor 43 is provided for moving the shaft 41. In the preferred embodiment shown in the drawings, the shaft 41 is a generally vertical rotary shaft and the motor 43 rotates the shaft. However, if desired, it is of course possible that the shaft 41 is a linearly displaceable rod that can be displaced linearly by the motor 43, and the shaft 41 may be generally horizontal, if desired. In both cases, the motor 43 suitably is located inside the lock housing 1 and preferably is a DC motor and possibly other types of suitable motors such as solenoid.

Figure 4:
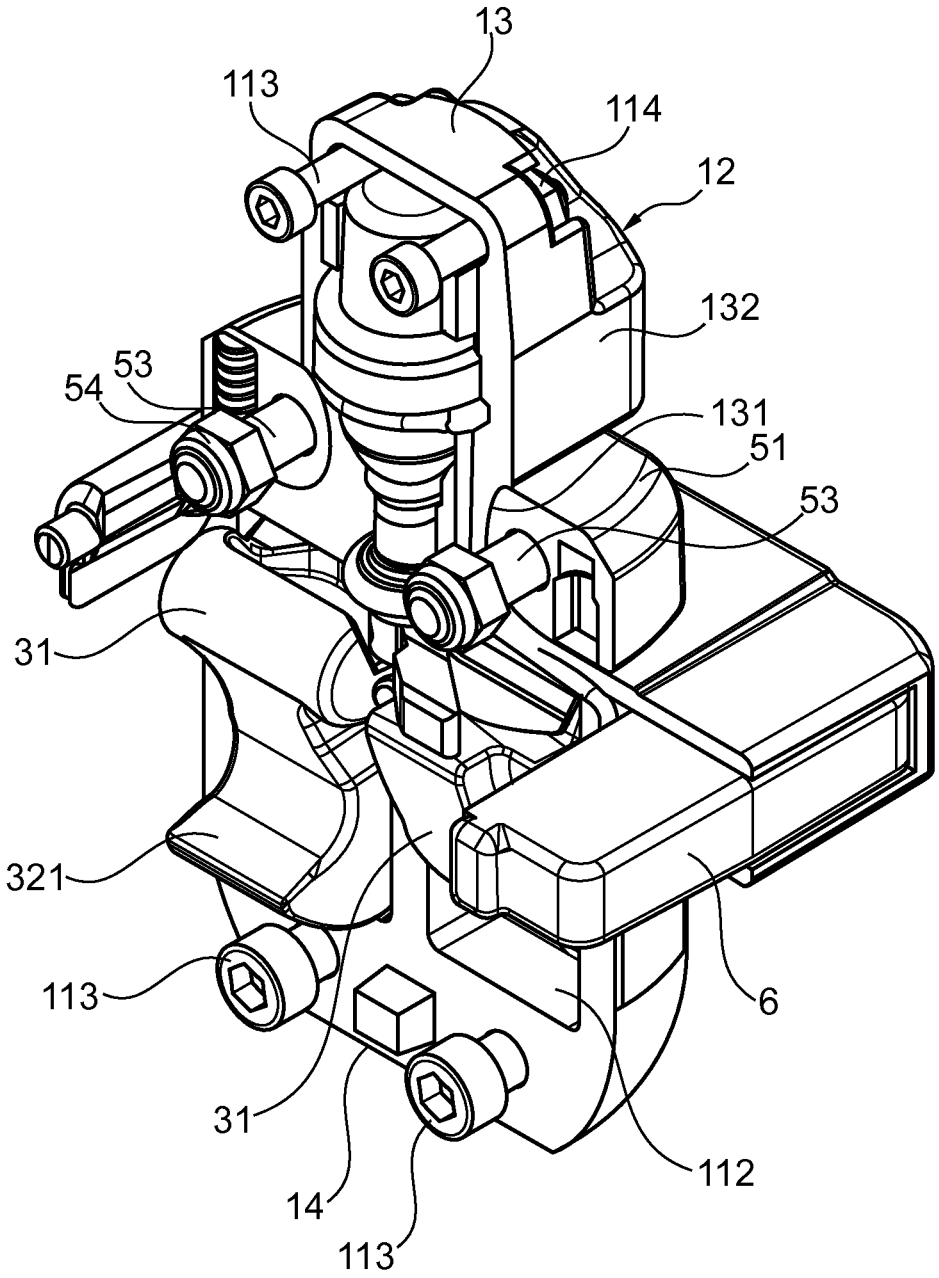
FIG. 4 is an isometric view of the lock of FIG. 1 wherein the housing is divided vertically into a first and a second housing part, and one of the housing parts is removed to show the interior including hook members and motor for pivoting the hook members.

It is also preferred that the lock comprises an internal device 6 shown e.g. in FIG. 4 and configured to transmit and receive information to and from an external communication unit (7, not shown). It is suitable that the internal device 6 includes a CPU 61, a memory (not shown) configured to store information regarding whether the lock is locked or unlocked, and an antenna 62 for wireless communication with the external communication unit. According to one embodiment, the internal device 6 may be equipped with a radio transmitter and receiver. Preferably, the internal device 6 also includes at least one battery (63, not shown) located inside the housing 1. The battery supplies the necessary energy for driving the internal communication device 6, the CPU 7, internal sensors for assessment and communication of the position of the lock (locked or unlocked) and the motor 43.

Unloading of a container 3 from a ship, which container 3 is superimposed and locked onto a lower container 3' by means of corner casting locks according to the invention, is now to be briefly described. As previously described, the stacked containers on a ship are secured onto each other by means of twistlocks during transport. Upon unloading a container 3, said four corner twistlocks are to be opened to permit release of the uppermost container and move it to the quayside by means of an STS crane. Thanks to the invention, opening of the locks may be done by remote control, signaling to the motor to turn said shaft 41 and move the bar 42 from a free configuration where the hook members 31, 32 may move in and out of the respective side openings 111, 112. Next, said crane grabs the container as known per se, and initiates a lifting movement. At this point, the generally horizontal abutment surface 312 of the hook end 311 will press against the inner horizontal surface 221' of the corner casting 2'. Since the pivot axis 33 of the hook member is displaced in relation to the hook end 311, pressing against the corner casting surface 221' will cause the hook to rotate inwards, and be pushed against the force of the spring 16 to retract into the housing 1 via the side opening 111. When being in a fully pushed-in position, the lock may be withdrawn from the corner casting 2' and the container 3 to be unloaded is thereby released from the lower container 3'

Figure 12A:
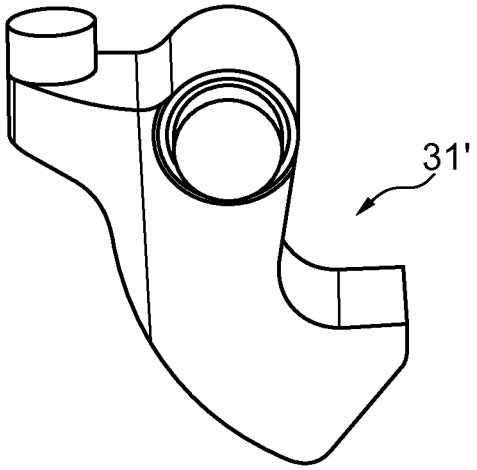
FIGS. 12*a-b* shows two examples of hook member designs.
Figure 12B:
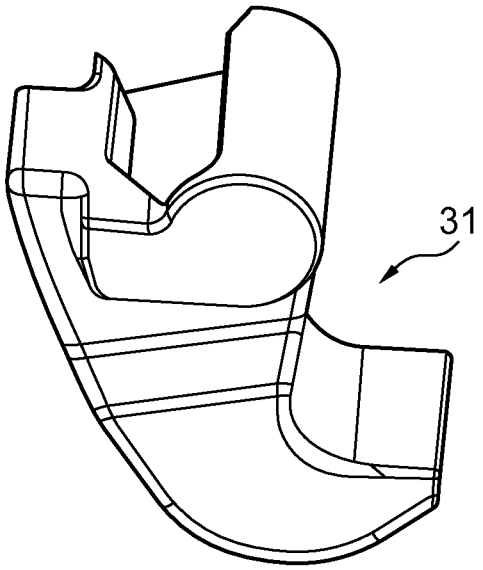
Figure 13A:
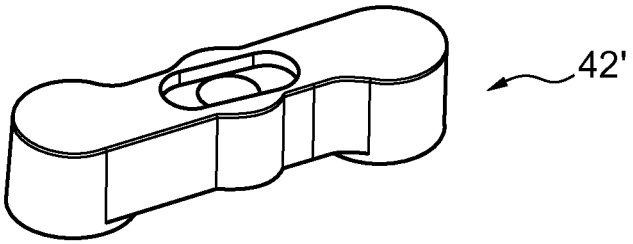
FIGS. 13*a-b* shows two examples of locking bar designs.
Figure 13B:
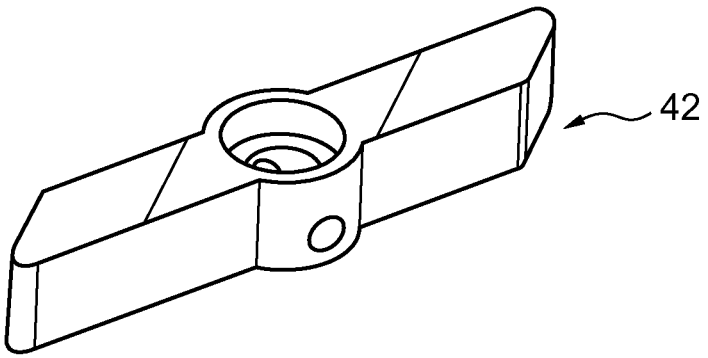

The invention is not to be seen as limited by the preferred embodiments described, but can be varied within the scope of the appended claims. For instance, said locking bar 42 and the corresponding hook member 31 and their locking engagement may be solved differently compared to the above described embodiment. In FIG. 12*a* there is seen a hook member 31' according to further embodiment according to the invention, with an upper surface having a protruding portion. The corresponding locking bar 42' is seen in FIG. 13*a*. This alternative hook member 31' configuration is based on the same principle as the one described above (and shown e.g. in FIGS. 6-8), namely to be operably connected to said locking bar 42' arranged to switch between a locked and an unlocked position.

Also, as an alternative to split the housing 1 vertically into two housing parts 11, 12 as herein described, the housing 1 can be split into two housing parts horizontally, preferably through the middle section 8, to create one upper housing part and one lower housing part. In the case of a horizontal split of the housing 1, the upper housing part and the lower housing part may be attached to each other by screws 113 and nuts 114, through the middle section 8 to form a unified housing 1.

Furthermore, the abutment surface 312 of the hook member 31 is preferably horizontal, however, the skilled person understands that the lock according to the invention may function also with said hook having a sloped abutment surface.

The invention claimed is:

1. A lock for securing upper and lower superimposed shipping containers in place, said lock comprising:

a vertical housing having a top portion and a bottom portion, the top portion having a shape fitting in a dedicated opening in a corner casting of the upper container, and the bottom portion having a shape fitting in a dedicated opening in a corner casting of the lower container;

said housing comprising a first and a second housing part; and said first housing part having a side opening at a lower end of the bottom portion;

a first hook member pivotally mounted within the housing and having a hook end that can be moved out and moved back through the side opening to couple the lock to and uncouple the lock from the corner casting;

a shaft mounted in the housing and operatively connected to said hook member to either lock the hook member in a moved-out position of said hook end or permit the hook member to move between the moved-out position and a moved-back position of said hook end;

a locking bar fixed to the shaft and upon movement of the shaft being movable between a locking position, where the locking bar engages a locking surface of the hook member, and a free position, where the locking bar is out of engagement with the hook member; and said top portion of the housing having a neck and there above a head comprising a retaining flange arranged to provide a retaining function when the top portion is fitted into said dedicated opening in the corner casting of the upper container.

2. The lock as claimed in claim 1, comprising a rotary guide neck being mounted around the neck, said guide neck having a peripheral shape made to fit in a dedicated opening in a corner casting of an upper container.

3. The lock as claimed in claim 2, wherein said rotary guide neck comprises a guide neck lock arranged to releasably lock the guide neck in relation to the head of a turn compared to the head.

4. The lock as claimed in claim 1, wherein the hook end of the hook member in the moved-out position has a generally horizontal first abutment surface adapted to abut on an inner side of a generally horizontal wall of the corner casting.

5. The lock as claimed in claim 1, wherein a spring presses the hook member toward the moved-out position of the hook end.

6. The lock as claimed in claim 5, wherein the hook end has a bottom portion with a guide surface that faces outward from the housing, said guide surface on insertion of the lock in the corner casting abutting on a rim of an opening in the corner casting to resiliently guide the lock to a predetermined position.

7. The lock as claimed in claim 1, wherein the hook member has a pivot axis and said locking surface adjacent the pivot axis, a locking bar is fixed to the shaft and upon movement of the shaft is movable between a locking position, where the locking bar at least upon lifting of a container engages said locking surface of the hook member, and a free position, where the locking bar is out of engagement with the hook member.

8. The lock as claimed in claim 7, wherein the hook member has a shoulder that projects generally horizontally from the pivot axis and, with reference to an intermediary vertical plane, in a direction opposed to that of the hook end, the locking surface being located on said shoulder.

9. The lock as claimed in claim 8, wherein the shoulder has a recess located at a side of the locking surface, the recess being shaped to receive a portion of the locking bar in the free position to permit moving the hook member back into the housing.

10. The lock as claimed in claim 8, wherein the housing has an internal abutment stopping any vertical upward movement of the hook member shoulder and the locking bar.

11. The lock as claimed in claim 1, wherein the head of the housing has a peripheral shape made to fit in a dedicated opening in an uppermost container and wherein the head is oriented perpendicularly to an orientation of the bottom portion of the housing.

12. The lock as claimed in claim 1, wherein the head of the housing has a peripheral shape made to fit in a dedicated opening in an uppermost container, and wherein the head is oriented in an angle of at least 45 degrees to an orientation of the bottom portion of the housing.

13. The lock as claimed in claim 1, wherein also the second housing part has a side opening at a lower end of the bottom portion, an additional hook member is pivotally mounted within the housing and has a hook end that can be moved out and moved back through the side opening of the second housing part, and the shaft is operatively connected to either lock the hook members in the moved-out position of said hook ends or permit the hook members to move between the moved-out positions and the moved-back positions of said hook ends.

14. The lock as claimed in claim 1, further comprising a motor for moving the shaft.

15. The lock as claimed in claim 14, wherein the shaft is a generally vertical rotary shaft and the motor rotates the shaft.

16. The lock as claimed in claim 14, wherein the shaft is a linearly displaceable rod and the motor displaces the shaft linearly.

17. The lock as claimed in claim 16, wherein the shaft is generally horizontal.

18. The lock as claimed in claim 14, wherein the motor is located inside the housing.

19. The lock as claimed in claim 1, further comprising inside the housing a device configured to transmit and receive information to and from an external communication unit, a CPU and a memory configured to store information regarding whether the lock is locked or unlocked.

20. The lock as claimed in claim 19, wherein the device includes an antenna and a radio transmitter/receiver for wireless communication with the external communication unit.

21. The lock as claimed in claim 19, further comprising at least one battery located inside the housing.

22. A system for securing upper and lower superimposed shipping containers in place, comprising a lower shipping container with an upper corner casting, an upper shipping container with a lower corner casting superimposed over said upper corner casting and at least one lock according to claim 19 wherein said lock is engaged in said upper corner casting and said lower corner.

23. A system according to claim 22 wherein said lower shipping container comprises four upper corner castings, said upper shipping container comprises four lower corner castings and such four locks.

* * * * *